US008214930B2

(12) United States Patent
Azodi

(10) Patent No.: US 8,214,930 B2
(45) Date of Patent: Jul. 10, 2012

(54) TOILET ODOR REMOVAL APPARATUS

(76) Inventor: Ghasem Azodi, Houston, TX (US)

( * ) Notice: Subject to any disclaimer, the term of this patent is extended or adjusted under 35 U.S.C. 154(b) by 0 days.

(21) Appl. No.: 12/848,226

(22) Filed: Aug. 2, 2010

(65) Prior Publication Data

US 2012/0023650 A1 Feb. 2, 2012

(51) Int. Cl.
*B03D 9/052* (2006.01)

(52) U.S. Cl. ..... 4/213; 4/214; 4/215; 4/216; 4/219

(58) Field of Classification Search ..... 4/213–216, 4/219, 347–352
See application file for complete search history.

(56) References Cited

U.S. PATENT DOCUMENTS 2,227,920 A * 1/1941 Baither ..... 4/213
2,603,797 A * 7/1952 Baither ..... 4/214
5,123,125 A * 6/1992 Menge ..... 4/349

* cited by examiner

*Primary Examiner* — Jason J Boeckmann
*Assistant Examiner* — Joel Zhou
(74) *Attorney, Agent, or Firm* — Delphine James

(57) ABSTRACT

The present invention's toilet provides a toilet odor removal apparatus The toilet may additionally provide a dual flushing system and/or water overflow prevention system. The odor removal apparatus is operable to withdraw air from a toilet bowl via a suction assembly comprised of a motorized fan to discharge air into a sewer discharge line through a ventilating passage. A valve assembly for controlling the configuration of the system includes a valve controlling means and a solenoid iron plunger. Three main configurations include water flow from the toilet tank to the bowl (flushing), no water flow to the bowl and air flow from the toilet bowl through the fan to the ventilating passage (odor removal), and finally no water flow or air flow (not is use).

6 Claims, 6 Drawing Sheets

TOILET ODOR REMOVAL APPARATUS

FIELD OF THE INVENTION

The present invention relates to toilets. Specifically, the present invention relates to a toilet with an odor removal dual flushing system, and/or water over low prevention system.

BACKGROUND

Toilets and sewers have been invented and used by the society of mankind for nearly five thousand years for disposing bodily waste discharged from the human body. Ever since toilets first became available, various forms of toilets have been designed to serve mankind for daily needs.

Toilets are designed for disposing solid and liquid waste, but are not suitable for disposing unwanted gases, i.e. odors Such odors may be unbearable and embarrassing. Worse, if there is not sufficient ventilation the odor can remain for hours. Although this problem arises from natural occurrences, one would appreciate the elimination or reduction of the odor during or after the discharge of the bodily waste. However, toilets widely available in the market in either commercial or residential settings do not provide an odor removing system.

SUMMARY OF INVENTION

The present invention makes simple additions to a basic toilet to equip the toilet with the ability to remove gaseous bodily wastes. The basic features of a toilet bowl included are the flush channel along, the rim of the bowl, siphon passage with one end connected to the bowl and the other end connected to a sewer discharge line, and the communication between the toilet tank and toilet bowl which allows flesh flush water to enter the toilet bowl, the present invention includes an odor removal passage having one end connected to the flush channel and another end joined to an air flow passage which connects to the siphon. A controlling means mounted within the toilet tank uses two solenoids to change the configuration of the system. The three main configurations include:

(1) closing the communication between the toilet tank and toilet bowl as well as closing the communication between the toilet bowl and air flow passage, (2) closing the communication between the toilet tank and toilet bowl while opening the communication between the toilet bowl and air flow passage, and (3) opening the communication between the toilet tank and toilet bowl while closing the communication between the toilet bowl and air flow passage.

The three configurations correspond to:

(1) the toilet is not in use, (2) the odor removal apparatus is on, and (3) the toilet is flushing.

The odor removal apparatus is mounted at an opening between the flush channel and the air flow passage. A motorized fan operates to withdraw air from the toilet bowl through the flush channel and thorough the air flow passage connected to the siphon. A controller controls the operation of the system and the timing of the configuration changes.

In accordance with this embodiment, the configuration is set by changes in position of the flush valve and air removal valve. The flush valve is comprised of the flush tower, flush valve body, and upper solenoid within the combination solenoid. The air flow valve is comprised of the lower solenoid in the combination solenoid, stopper and flush valve body.

In accordance with one embodiment, the airflow passage may be disposed adjacent to the siphon passage of the toilet.

In another embodiment, the toilet may further comprise a sensor for assisting the controller to function automatically. The sensor may be mounted on an exterior of the toilet tank, such as the flush handle.

In another embodiment, the present invention provides a mechanism for dual flush based on the timing of the user seated on the toilet seat In another embodiment, a sensor may be mounted on the toilet to rim to sense the water level within the toilet bowl This sensor can be used for overflow prevention.

In a further embodiment, the two solenoid plungers within the combination solenoid may be spring-loaded. The lower solenoid may be a tension spring-loaded plunger to hold the first valve (airflow valve) in the closed configuration and the upper solenoid may be a compression spring-loaded plunger to hold the second valve (flush tower) in the closed configuration.

BRIEF DESCRIPTION OF THE DRAWINGS

The present invention will be described by way of non-limiting embodiments, with reference to the accompanying drawings, in which.

DETAILED DESCRIPTION

Figure 1:
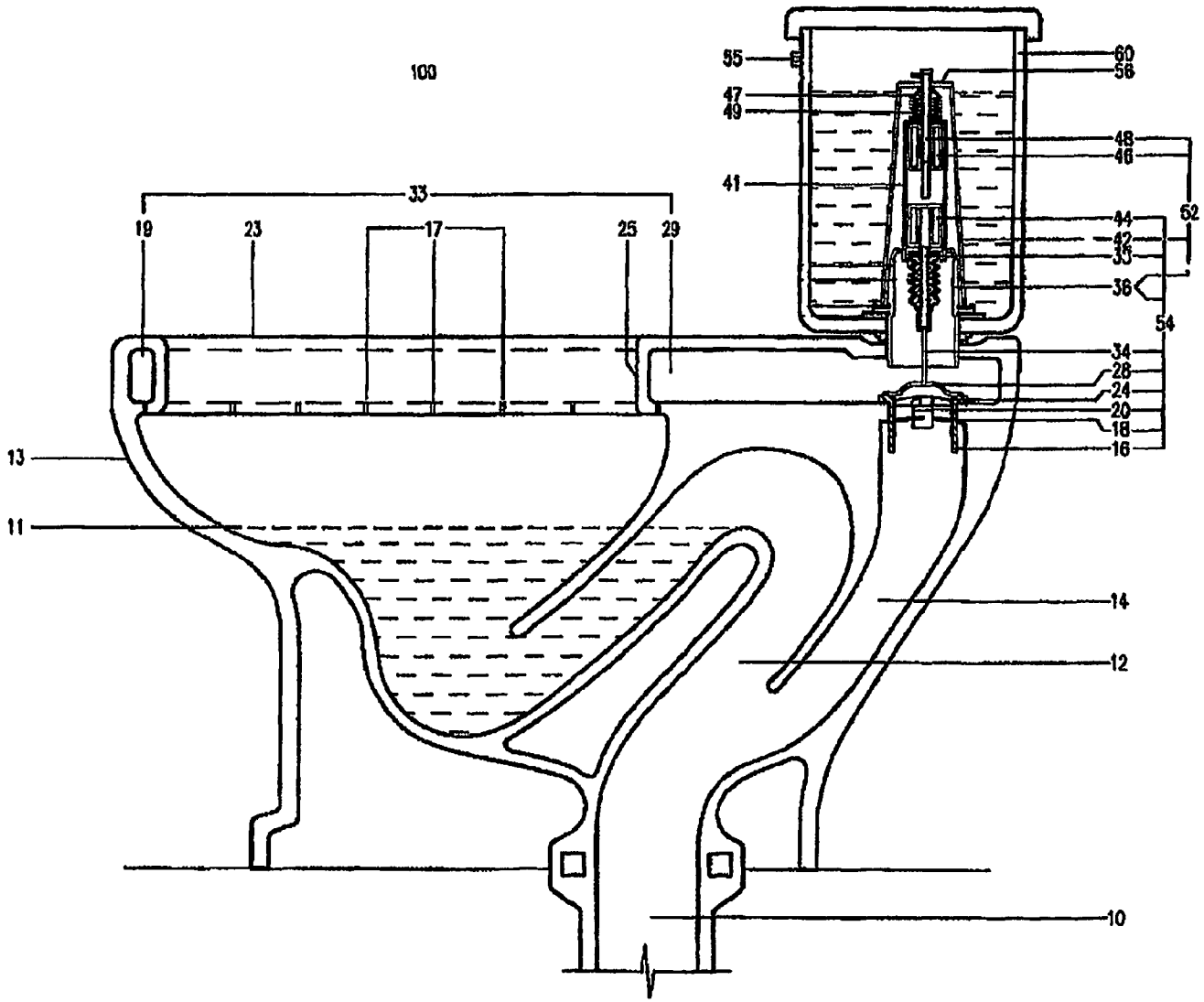
FIG. 1 illustrates a first configuration of the flush valve and air flow valve. The flush
valve is closed as is the air flow valve. This configuration is present when the toilet is not in use in accordance with an embodiment of the invention.
Figure 1A:
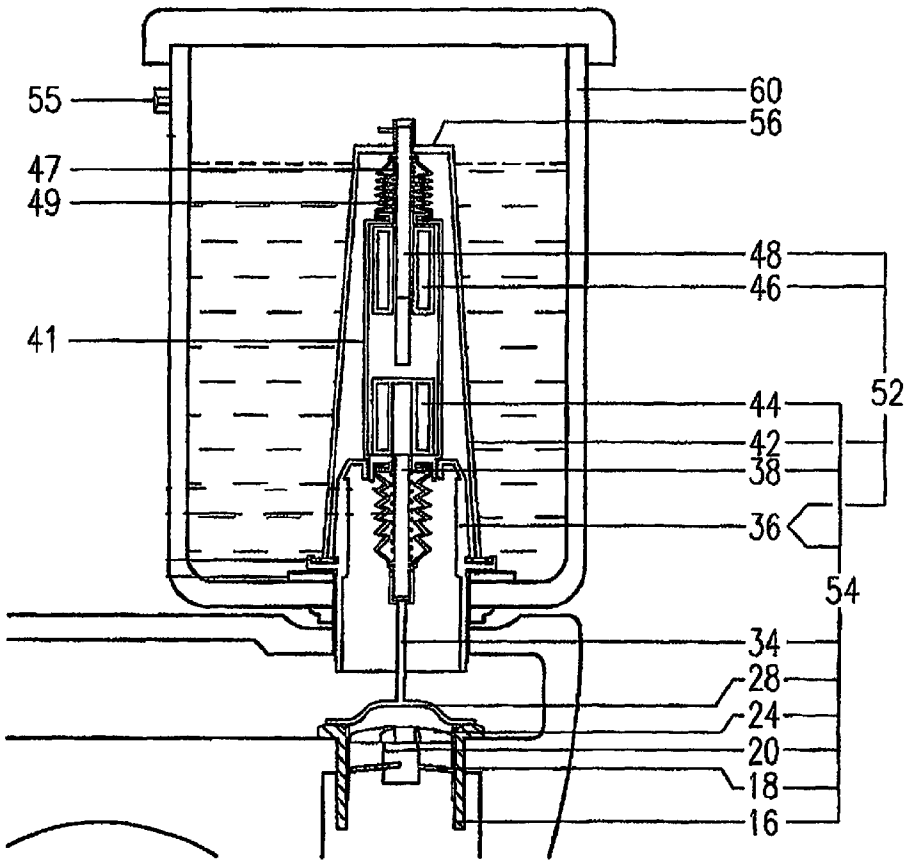
FIG. 1A illustrates a cut away view of the flush valve and air flow valve configuration when toilet is not in use.

In line with the above summary, the following description of a number of specific and alternative embodiments is provided to understand the inventive features of the present invention It shall be apparent to one skilled in the art however, that this invention may be practiced without such specific details. Some of the details may not be described at length so as not to obscure the invention. For ease of reference, common reference numerals will be used throughout the figures when referring to the same or similar features common to the figures.

For all figures, the flush valve (52) consists of the flush tower (42), flush valve body (36), and upper solenoid (46) within the combination solenoid (41). These parts together control the movement of the flush tower (42) to open the communication of the toilet tank (60) with the toilet bowl (13)

when the flush tower (42) is raised and close the communication of the toilet tank (60) with the toilet bowl (13) when the flush tower (42) is lowered. The air flow valve (54) consists of the lower solenoid (44) in the combination solenoid (41), stopper (28), and the flush valve body (36). These parts control the movement of the stopper (28) to open communication of the toilet bowl (13) with the air flow passage (14) when the stopper is raised and close the communication of the toilet bowl (13) with the air flow passage (14) when the stopper is lowered.

In a further embodiment, the two solenoid plungers (38, 48) within the combination solenoid (41) may be spring-loaded. The lower solenoid (44) may include a tension spring-loaded (37) lower plunger (38) to hold the air flow valve (54) in the closed configuration and the upper solenoid (46) may include a compression spring-loaded (47) top plunger (48) to hold the flush valve (52) in the closed configuration.

Returning to FIG. 1, there is shown a first configuration of the flush valve (52) and air flow valve (54) of the toilet not in use. In this configuration, both the flush valve (52) and air flow valve (54) are generally closed while the toilet is not is use. As depicted, by the default the top plunger (48) for the upper solenoid (46) is pulling the flush tower (42) down to close the flush valve (52). The lower plunger (38) for the lower solenoid (44) is pushing the stopper (28) down to close the air flow valve (54).

Figure 2:
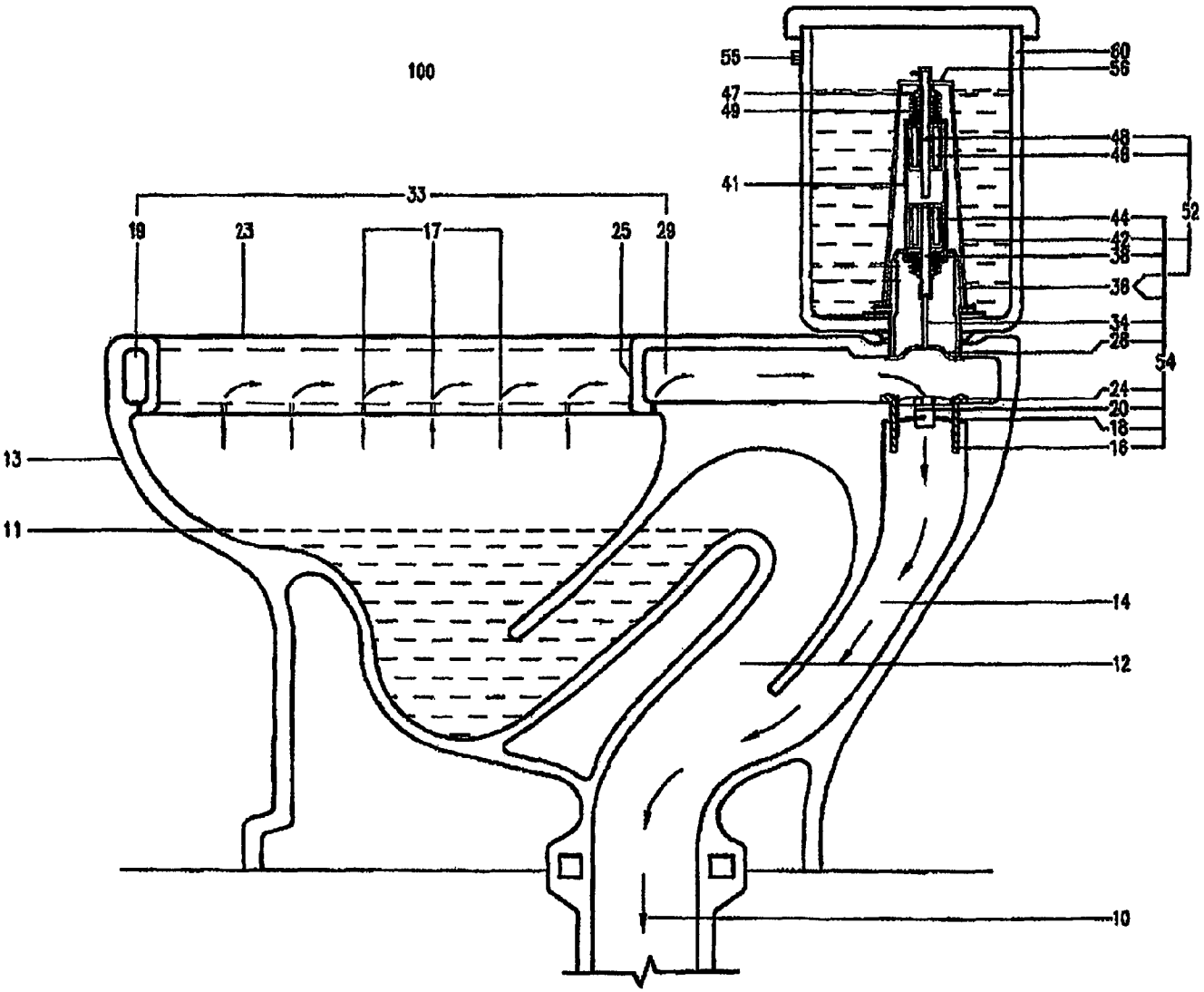
FIG. 2 illustrates a second configuration of the flush valve and air flow valve. The flush valve is closed while the air flow valve is open. This configuration occurs when the odor removal apparatus is on and allows air from the toilet bowl to be drawn into the air flow passage in accordance with an embodiment of the invention.
Figure 2A:
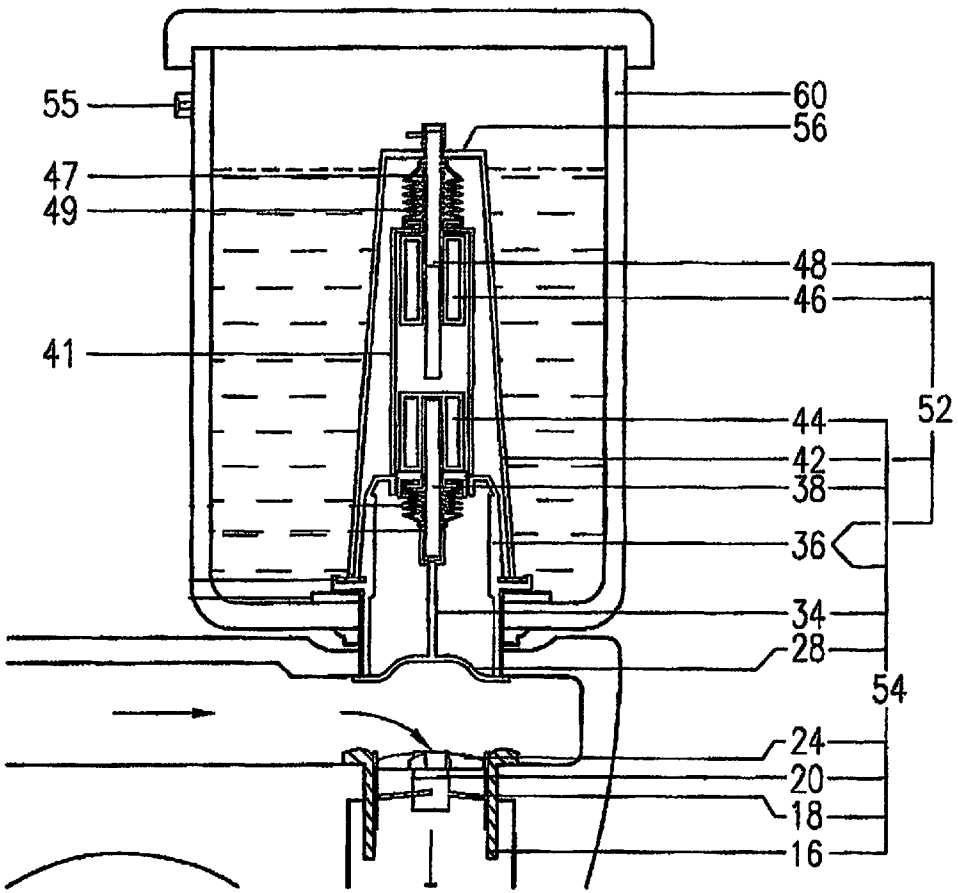
FIG. 2A illustrates a cut away view of the flush valve and air flow valve configuration when someone is sitting on the toilet seat.

FIG. 2 illustrates a second configuration of the flush valve (52) and air flow valve (54). This configuration with the flush valve (52) closed and the air flow valve (54) open generally occurs when the odor removal apparatus is on and the toilet is in use. The odor removal apparatus (100) further comprise a sensor (55) with a controller to assist in automatically directing the functionality of the combination solenoid (41). The sensor may be mounted on an exterior of the toilet tank, such as the flush handle. The top plunger (48) for the upper solenoid (46) is pulling the flush tower (42) down to close the flush valve (52). The lower plunger (38) for the lower solenoid (44) is pulling the stopper (28) up to open the air flow valve (54).

The other portion of the air flow valve (54) that controls the odor comprises the motorized fan (20) and supporting structures (16, 18) to mount the fan at the junction of the tank flush channel (29) and the air flow passage (14). The flush channel (60) is continuous and formed by bowl flush channel (19) along the toilet bowl rim and tank flush channel (29). The flush channel (19) of the toilet bowl (13) are supported by holes (17) disposed along the circumference of the inner peripheral edge of toilet bowl (13). The tank flush channel (29) is disposed directly above air flow valve (54)

To place the toilet in use, a user sits on the toilet bowl (not shown) which causes the sensor controller (55) to send a signal to actuate the lower solenoid (44) to pull stopper (28) to open air flow valve (54). Simultaneously, the sensor controller (55) sends a signal to actuate the motorized fan (20). When the air flow valve (54) is open, as in this configuration, the motorized fan (20) is automatically turned on causing suction of air (along with odors) in from the toilet bowl (13) through the holes (17) of the bowl flush channel (19) and tank flush channel (29) into the air flow passage (14) to the sewer discharge line (10). In this configuration the toilet tank (60) flush water is contained solely in the tank and there is no water in the flush channel (33).

It is important to note the stopper (28) in FIG. 2 fits tightly against the base of the flush valve body (36). This is necessary because the flush tower (42) provides the same function as an overflow valve. In a normal toilet, a cylinder in the toilet tank (60) is positioned so that an open end is just above the water level. The other end of this cylinder is connected to the siphon. If the water level in the toilet tank (60) rises above this cylinder, it will flow into the cylinder through its open end into the siphon, attempting to prevent overflow of water into the toilet bowl (13).

In order to fulfill this function, the top of the flush tower (42) or (56) have openings which are in fluid communication with the toilet tank (60). Therefore, in this second configuration when the odor removal apparatus is turned on and the motorized fan (20) is working, there is a potential of communication between the tank flush channel (29) and the toilet tank (60). To prevent inefficiency in the system due to the motorized fan (20) having to draw air from this site as well as the toilet bowl (13), the stopper (28) fits against the base of the flush valve body (36) to allow only communication between the toilet bowl (13) and the air flow passage (14).

While the user is on the toilet seat the sensor controller (55) determines the amount of time the user is using the toilet and sets a timer. When the user gets up, a signal is automatically sent to actuate the upper solenoid (44) to open flush valve (52) for a predetermined period of time based upon the timer as shown in FIG. 3 which is the configuration illustrating the dual flush functioning for saving water.

Figure 3:
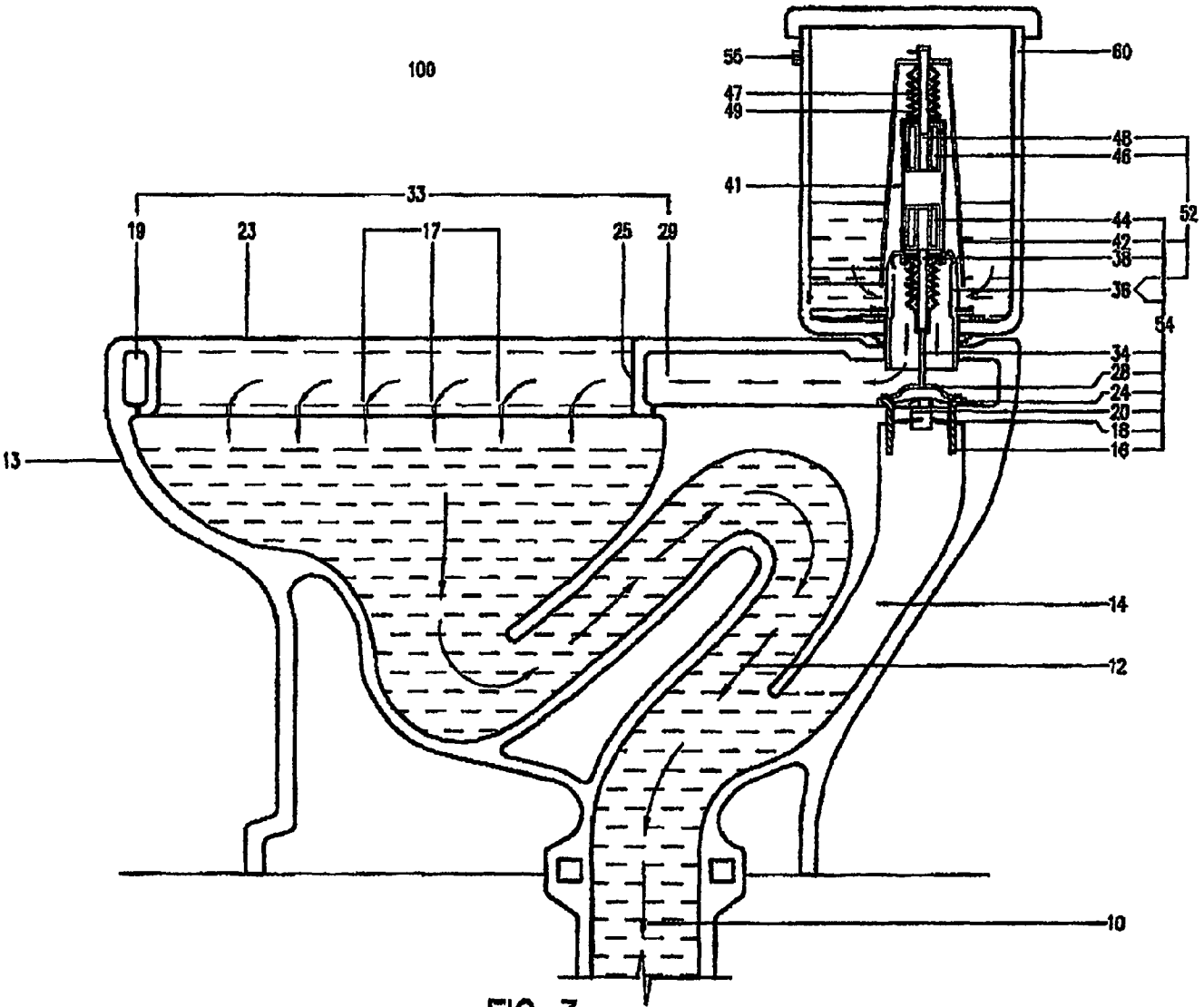
FIG. 3 illustrates a third configuration of the flush valve and air flow valve. The flush valve is open while the air flow valve is closed This configuration occurs when the toilet is being flashed and allows toilet tank flush water to enter the toilet bowl without this water flowing into the air flow passage in accordance with an embodiment of the invention.
Figure 3A:
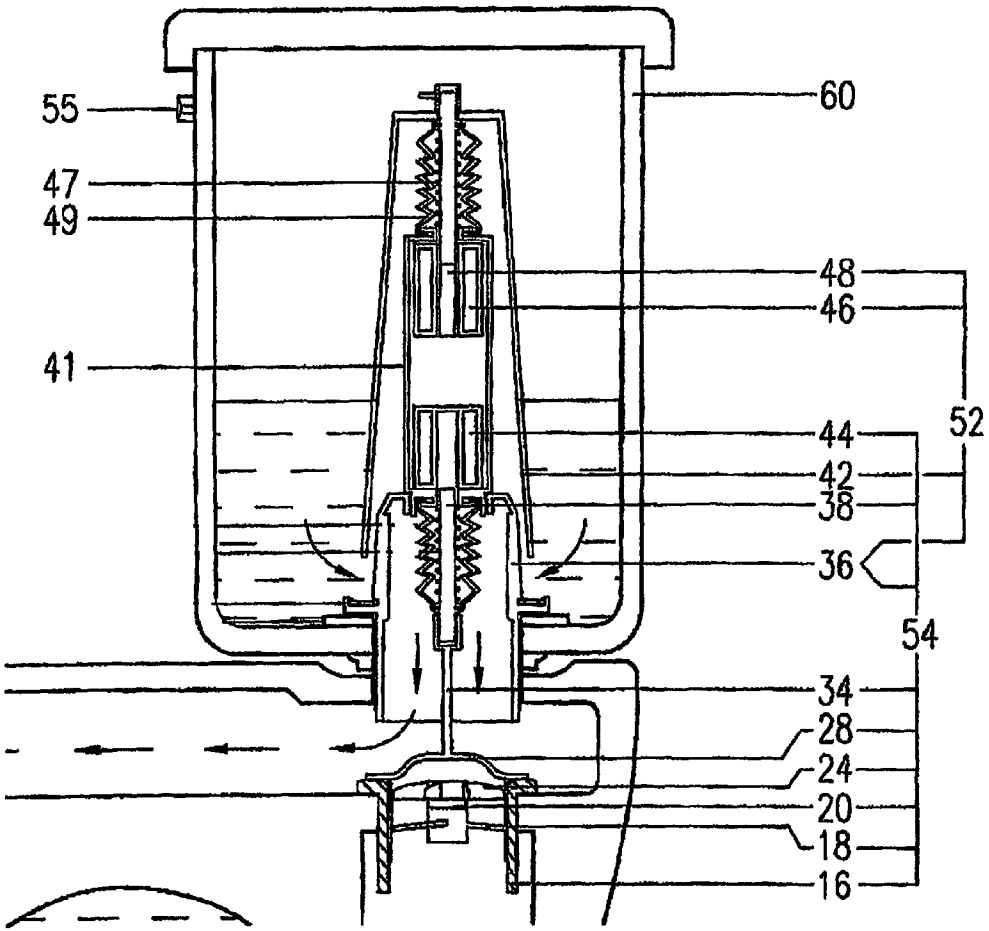
FIG. 3A illustrates a cut away view of the flush valve and air flow valve in the flush position.

FIG. 3 illustrates a third configuration of the flush valve (52) and air flow valve (54) which occurs when the user gets up off of the toilet seat. This configuration is with the air flow valve (54) closed generally and the flush valve (54) open occurs when the toilet is being flushed. The top plunger (48) for the upper solenoid (46) is pushing the flush tower (42) up to open the flush valve (52). The lower plunger (38) for the lower solenoid (44) is pushing the stopper (28) down to close the air flow valve (52). As described earlier, the bowl flush channel (19) of the toilet bowl (13) has holes (17) along the edge. This bowl flush channel (19) is continuous with the tank flush channel (29). In this configuration there is communication between the toilet tank (60) and the toilet bowl (13) through the flush channels (33). Fresh flush water exits the toilet tank (60) and flows through the tank flush channel (29) and bowl flush channel (19) into the toilet bowl (13) through the holes (17) along the bowl flush channel (19). In this configuration, the air flow valve (54) is tightly sealed and no water flows in to air flow passage (14). The water pressure flushed into the bowl (13) from the path causes the siphon effect that create a vacuum the toilet bowl water (and waste therein, if any) to the siphon passage (12) and out to the sewer discharge line (10).

If the timer is set for more than the predetermined amount of time, then a full flush cycle is required with tank (60). However, if the timer is set for less than the predetermined amount of time, then a smaller flush cycle is required for tank (60). The timer is set based upon the amount of time a user sits on the toilet seat. Normally, if a person only urinates, it takes a lesser amount of time than if they perform a bowel movement within toilet bowl (13). The timer determines the amount of time the signal actuates upper solenoid (46) to open the flush valve (54). In the preferred embodiment, the predetermined amount of time is approximately 2 seconds.

The embodiments above have illustrated a sealed type toilet. It is understood to the person skilled in the art that the present invention can also be applied to a squat toilet in accordance with an alternative embodiment of the present invention.

In this embodiment, the present invention provides a mechanism for dual flush based on the timing of the user seated on the toilet seat If a user sits on the toilet seat for longer than a predetermined amount the upper solenoid (46) keeps the flush valve (52) opened to allow the tank (60) to empty.

In another embodiment, the present invention further includes a sensor system to prevent water overflow. A water detector sensor is mounted within the rim of the toilet bowl as indicated by overflow sensor (25) on FIGS. 1, 2, and 3. This overflow sensor (25) is coupled to a controller which terminates or closes the flush valve (54) automatically to stop water flow into the toilet bowl (13) once the water level reaches the overflow sensor (25). The location of the sensor is key in order to avoid unnecessary activation of the overflow prevention system. When the water reaches a certain level, the sensor sends a signal to upper solenoid (46) to lower flush tower (42) thereby closing flush valve (52).

What is claimed is:

1. An odor removal apparatus for a toilet bowl, the odor removal apparatus comprising:

a toilet tank having an internal cavity for holding flesh flush water coupled to the toilet bowl; the toilet tank having a bottom section with an outlet port into the toilet bowl;

the toilet bowl having a seat situated above a rim having a circumference with a plurality of holes surrounding therein;

the toilet bowl and the toilet tank in fluid communication through a flush channel aligned below the outlet port and extending laterally into the plurality of holes along the rim of the toilet bowl;

an air flow passage having an upper end starting at the flush channel and extending downward to a terminating end at a siphon leading to a sewer opening located through a floor into a connected sewer pipe;

a combination solenoid disposed within the internal cavity of the tank;

the combination solenoid having an upper solenoid disposed directly above a lower solenoid;

a flush valve consisting of a flush tower and the upper solenoid positioned directly above a flush valve body;

the flush tower encapsulating the upper solenoid and the flush valve body;

an air flow valve consisting of the lower solenoid, a stopper, and the flush valve body; the lower solenoid situated within the flush valve body and directly connected to the stopper disposed at an entrance opening between the flush channel and the air flow passage;

a motorized fan encapsulated by a supporting structure mounted at the entrance opening between the flush channel and the air flow passage below the stopper, a controller mechanism mounted on the tank or externally near the tank and in electronic communication with the combination solenoid for controlling an open and close position of the flush valve and the air flow valve;

when a user sits on the seat, the controller mechanism adapted to send a signal to the lower solenoid wherein the stopper is raised to open the air flow valve causing the motorized fan is automatically start such that the odorous air is drawn into the air flow passage through the flush channel into the sewer pipe;

when the user gets off the seat, the controller mechanism adapted to terminate the signal to the lower solenoid wherein the stopper is lowered closing the air flow valve causing the motorized fan is automatically stop; and simultaneously, when the user gets off the seat, the controller mechanism is adapted to send a signal to the upper solenoid wherein the flush valve is opened causing the flush tower to be raised above the flush valve body such that the flush water enters the toiled bowl.

2. The odor removal apparatus according to claim 1, wherein the toilet bowl further comprising:

a separate siphon passage conduit leading into the siphon;

a bowl member situated below the rim;

the airflow passage is disposed adjacent to the siphon passage conduit; and the siphon passage conduit situated between the a bowl member and the air flow passage.

3. The odor removal apparatus according to claim 1, wherein the controlling mechanism is a sensor which may be externally mounted to the toilet and is used in conjunction with the controlling mechanism to time opening of the flush valve.

4. The odor removal apparatus according to claim 1, wherein the upper and lower solenoid are spring-loaded valves.

5. The odor removal apparatus according to claim 1, wherein the controller mechanism further comprises:

a timer adapted to determine the amount of time the user sits on the seat is greater than a predetermined amount of time;

if the user sits upon the seat longer than the predetermined amount of time than the flush valve is opened to allow flush water to empty the tank; and if the user sits upon the seat less than the predetermined amount of time than the flush valve is opened a shorter amount of time wherein the amount of flush water does not empty the tank.

6. The odor removal apparatus according to claim 1, wherein the toilet further comprises:

a second controller mechanism mounted to the rim to sense the water level; and if the water level the toilet bowl reaches the rim, a signal is sect to the upper solenoid to close the flush valve.

* * * * *